United States Patent [19]

Koski

[11] 4,391,217

[45] Jul. 5, 1983

[54] SIZE PRESS WITH COATING POOL SUPPRESSING ARRANGEMENT

[75] Inventor: Erkki Koski, Jyväskylä, Finland

[73] Assignee: Valmet OY, Finland

[21] Appl. No.: 323,426

[22] Filed: Nov. 20, 1981

[30] Foreign Application Priority Data

Nov. 28, 1980 [FI] Finland ..... 803708

[51] Int. Cl.[3] ..... B05C 3/12

[52] U.S. Cl. ..... 118/405; 118/429

[58] Field of Search ..... 118/404, 405, 414, 259, 118/227, 258, 424, 419, 429

[56] References Cited

U.S. PATENT DOCUMENTS 3,150,997 9/1964 Pelletier ..... 118/407

4,034,707 7/1977 Hansen ..... 118/407

4,325,784 4/1982 Dreher ..... 118/405 X

*Primary Examiner*—John P. McIntosh

*Assistant Examiner*—Mary Beth Calligaris

*Attorney, Agent, or Firm*—Steinberg & Raskin

[57] ABSTRACT

A size press having at least one coating nip avoids splashing of the sizing or equivalent coating agent by leading the web to be treated through said nip. Coating supply apparatus supplies coating pools at the nip entrance between a coating roller and the web entering said nip. The coating supply apparatus includes filling pieces in the nip entrance, placed in the coating pool in operating position. The filing pieces consist of permeable, porous, or perforated material and extend along the entire width of the web. The filling pieces suppress the coating pools and prevent or, at least, essentially decrease, the splashing of the coating agent.

10 Claims, 3 Drawing Figures

SIZE PRESS WITH COATING POOL SUPPRESSING ARRANGEMENT

BACKGROUND OF THE INVENTION

The present invention relates to a size press. More particularly, the invention relates to a size press with a coating pool suppressing arrangement.

The size press comprises two or more coating rollers which form one or a plurality of coating nips with each other. The web to be treated is arranged to run through the coating nip or nips, preferably in a main direction from up to down. The size press further comprises coating supply apparatus for supplying a coating pool or pools at the nip entrance between the coating roller and the web entering the coating nip or nips.

The surface sizing of paper is usually made by an "on-machine" size press disposed in the paper machine. Several different operations affecting the properties of paper and board may be carried out by the size press.

As known, the paper web is run through the roller nip of the size press. The coating agent is supplied to paper in the press by forming a pool or pools in front of the nip. The web gets wet in the pool or pools and adsorbs the coating agent on itself. The coating agent is pressed into the web between the rollers of the size press, due to hydrodynamic pressure. A film of the coating agent is simultaneously formed, due to hydrodynamic pressure, between the paper and the roller, splitting at the nip exit, thereby leaving a layer of coating agent on the surface of the paper. The thickness of the coating agent layer depends on the viscosity of the coating agent, the speed of the machine, the diameter of the roller, the surface characteristics of the roller, the linear load and factors caused by the transformation of the roller.

As known, the oldest of size presses is the so-called vertical size press, in which the rollers are placed one on top of the other and the paper runs horizontally between said rollers. In the known horizontal size press, the rollers are placed in the same horizontal plane and the paper runs vertically between said rollers. A third type of known size press is the so-called oblique press, in which the rollers are placed one on top of the other at an angle of about 45°. This is the best known solution regarding the running of the web at high operating speeds.

As known, the web is led into the size press by one or two guide rollers, of which the distance of that closest to the press nip from the press is important. The last-mentioned guide roller is adjustable and, via means for moving said roller, it is possible to adjust the coating pool passing time, that is, the adsorption time. It is also possible to treat only one side of the paper in the size press.

In the known size presses, the tail of the web is carried by ropes, and the tail is released from the ropes as soon as possible. A paper widening roller is used in front of the drying cylinder, in order to avoid wrinkles.

A serious problem in size presses is the splashing of the sizing or equivalent coating agent. The disadvantages of splashing are accentuated when the speeds of the size presses are increased. Splashing is especially considerable in "on-machine" size presses.

The diameters of the rollers of the size press are important regarding the suitability to operation. In the known size presses, the diameters of the nip rollers are fixed to about 800–1500 mm at operating speeds of 10–17 m/s. As known, it is attempted, by increasing the roller diameter as the speed increases, to prevent splashing in the pool entrance, because this disturbs the even wetting of the paper web.

As known, rubber is primarily used as the covering material of the rollers of the size press. Known size presses utilize a hard roller of metal and soft roller covered by rubber. Thus, softer and harder pressing zones are used. The diameters of the rollers are increasing as the operating speeds and the widths of the machines are changing. Not only is a sufficient wetting time required in order to achieve a good starch penetration, but also a high pressing load, 40–50 kN/m.

The most common surface sizing agent used for increasing the strength of the web is starch. Lesser used bonding agents are CMC and different synthetic bonding agents such as PVA. Furthermore, porosity decreasing agents, which are often simultaneously also bonding agents, are used. Several different paper additives, which may be applied to paper by the size press, are used as other surface treatment agents for paper or board.

The size press is suitable as the means for applying different additives due to the fact that the retention to paper is 100%, due to the use of the size press. It is possible to apply the coating onto the surface of the paper only, even onto one surface only, if necessary, due to the use of the size press. Plain water is sometimes also used in the size press for improving the moisture profile or for improving the dimension stability.

The production of fine paper is shifting to large paper machines, which imposes great requirements on the size presses. A poorly operating size press decreases the productivity of the entire paper machine. Thus, the size press of the invention presents some solutions that have been developed especially regarding high operating speeds.

Although the term "size press" is used herein, it must be understood that in this context the term "coating agent" is intended to have a wide meaning, so that it also comprises other known treatment agents, for paper or board webs, which are suitable for use in apparatus similar to that disclosed.

It must also be emphasized that the size press of the invention is suitable for use as a so-called "off-machine" coating machine.

As hereinbefore mentioned, a serious disadvantage of known size presses and corresponding coating machines is the splashing of the sizing agent or corresponding coating agent. Such splashing may even totally spoil the web being produced. The disadvantages caused by splashing have been accentuated as the speeds of size presses have increased. Splashing problems have thus been especially marked in on-machine size presses.

In the known size presses, splashing has occurred especially in coating pools. It has been attempted to avoid this disadvantage by arrangements, disclosed in U.S. Pat. Nos. 3,018,757 and 3,150,997, using plates with dense covering, pipes or rods. However, the devices of these patents for suppressing the coating pool, are so placed relative to the pool that there is no direct connection of the pool with the web. The coating agent is supplied by a roller connected to the pool through the surface of the roller into the nip through which the web runs. In such known coating supply apparatus, the splashing of the coating agent is not such an accentuated problem as in coating machines in which the web runs directly through the coating pool.

As known, it has been attempted to avoid the aforementioned splashing problems by using large rollers, so that a sufficiently small radial acceleration is achieved by the rollers. However, at high web speeds this arrangement leads to unreasonably large roller diameters. The large roller diameters again lead to an expensive space-consuming structure.

SUMMARY OF THE INVENTION

The principal object of the invention is to provide a size press which overcomes the disadvantages of known size presses.

An object of the invention is to provide a size press in which splashing of a coating agent from the coating pools preceding the coating nip or nips is entirely prevented, or at least decisively decreased.

Another object of the invention is to provide a size press which is suitable for operation at higher web speeds than heretofore.

Still another object of the invention is to provide a size press which is an "on-machine" apparatus of a paper machine and operates at web speeds as high as those of the paper machine.

In order to achieve these objectives, and others which will become apparent, the size press of the invention is primarily characterized by the arrangement of filling pieces in the nip entrance or entrances. The filling pieces are part of coating supply apparatus for supplying coating pools at the nip entrance. The filling pieces consist of porous permable or perforated material, or the equivalent, and function to suppress the coating pool and prevent, or substantially decrease, the splashing of the coating agent.

When one or a plurality of filling pieces, consisting of porous or perforated material according to the invention, are used in the coating supply apparatus, it is possible to suppress the coating pool substantially and thereby prevent splashing. The suppression of the coating pool is based on the suppressing effect of the porous or perforated structure of the filling pieces. When the filling piece is porous or perforated, it has the advantage that the pore or hole volume of all the filling pieces is available as coating agent volume, whereby the volume of the space to be reserved for the coating pool does not become too large.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
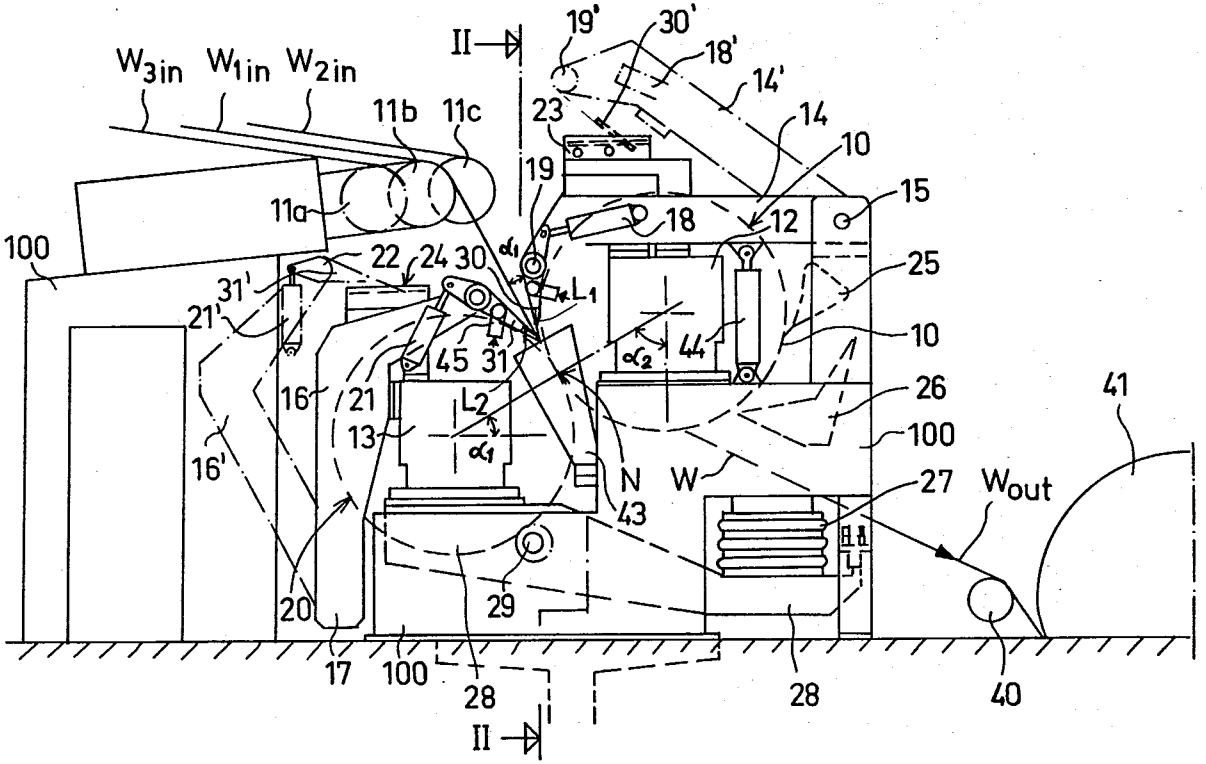
FIG. 1 is a schematic side elevation of an embodiment of a size press of the invention.

The size press of the invention comprises a frame part 100 having bearing supports 12 and 13, on which the coating rollers 10 and 20 are suspended. The coating rollers 10 and 20 have relatively large diameters and, if necessary, are provided with variable or adjustable crowns, forming a coating nip N. The web W to be coated enters the machine via an entrance $W_{in}$ and exits from the size press via an exit $W_{out}$. The paper web W is led into the coating nip N via a guide roller 11, for which three alternative positions 11*a*, 11*b* and 11*c*, are shown in FIG. 1. The positions 11*a* and 11*c*, and the corresponding web entrances $W_{3in}$ and $W_{2in}$ correspond to the unilateral sizing of the web W. The center position 11*b* of the guide roller 11 and the web entrance $W_{1in}$ belong to a double-sided coating of the web, in which the web is led centrally and tangentially into the nip N, so that the entrance angle $\alpha_1$in relation to the vertical plane is essentially as large as the central angle $\alpha_1$ of said nip on the roller 20. The angle $\alpha_2$ represents the angle after which the web W is released and the angle $\alpha_2$ is preferably about 60°. If necessary, deviations from the forgoing angle values are possible.

Figure 2:
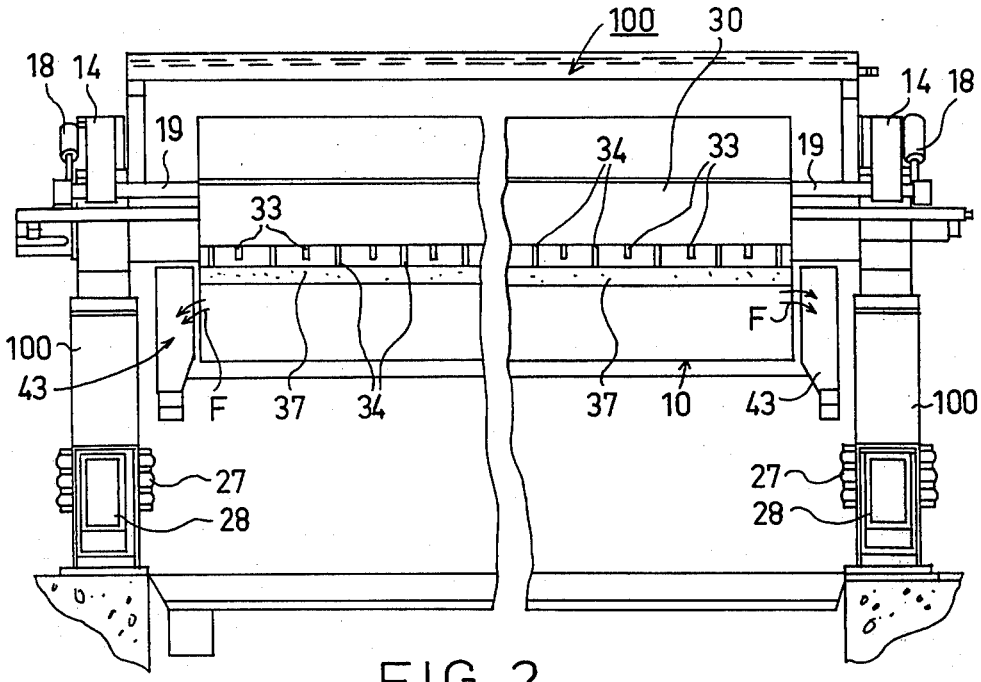
FIG. 2 is a sectional view, taken along the lines II—II, of FIG. 1.

In FIG. 1, the web W runs at an oblique angle from up to down, but the arrangement according to the invention is also suitable for use in other types of size presses such as, for example, in presses in which the running of the web through the coating nip N is essentially vertical from down to up. In FIGS. 1 and 2, the lower coating roller 20 is mounted in the frame part 28 by bearings. The frame part 28 is rotatable about a fulcrum axle 29 by a bellows device 27 for adjusting the linear load in the coating nip N.

In accordance with the invention, coating supply apparatus is arranged so that it precedes the coating nip on both sides of the web W. The apparatus includes special devices, in accordance with the invention, to prevent, or at least decisively decrease, the splashing of the coating agent and to suppress the coating pools $L_1$ and $L_2$ (FIG. 3) in the spaces between the web W and the rollers 10 and 20.

The apparatus 30 and 31 for supplying the sizing agent, or other corresponding coating agent or agents, to form the pools $L_1$ and $L_2$, preceding the nip N, comprises frame parts such as, for example, box beams 46 and 47. The coating supply apparatus 30 is connected with the upper coating roller 10 and is placed between side beams 14, so that it is supported by an axle 19. The pair of side beams 14 is affixed to the frame 100 of the machine by fulcrum axles 15 and are turnable by a pair of hydraulic cylinders 44 to a position 14'. In the position 14', the coating supply apparatus 30 is a non-operating position 30', shown in FIG. 1 by an interrupted dotted line.

Correspondingly, the coating supply apparatus 31 connected with the roller 20 is affixed between side beams 16. The beams 16 are affixed to the frame by the fulcrum axles and are turntable by a pair of hydraulic cylinders (not shown in the Figs.) from an operating position shown by full lines to a non-operating position 16' shown by interrupted dotted lines. In non-operating positions 30' and 31', the coating supply apparatus, and especially the tip parts thereof, covered by the coating agent, are immersed in water, or other corresponding liquid or solvent, in basins 23 and 24. This prevents the drying of the coating agent, and thereby prevents the hardening and blocking of the coating supply apparatus.

Figure 3:
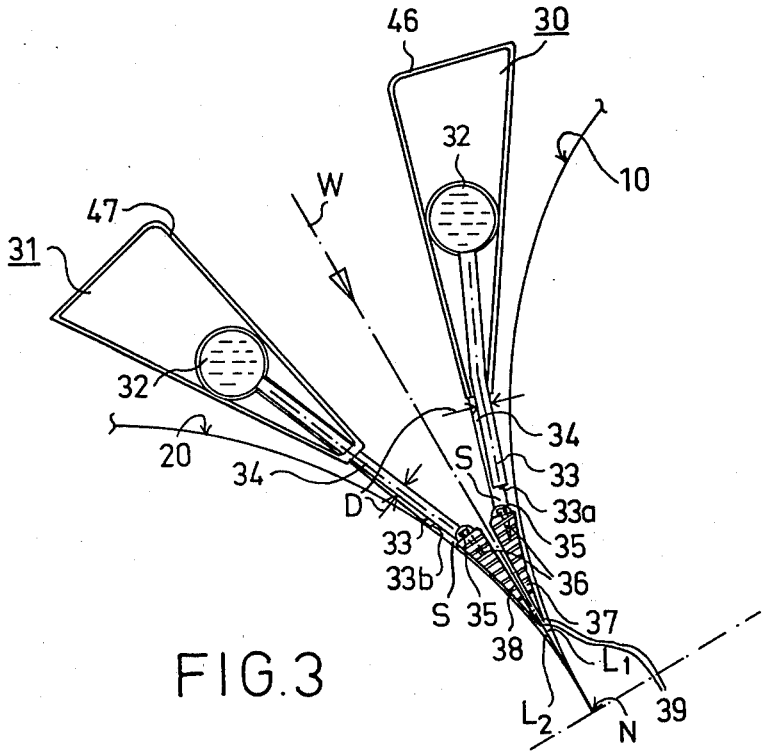
FIG. 3 is a cross-sectional view, on an enlarged scale, of an embodiment of the coating supply apparatus and the coating pool suppressing apparatus of the size press of the invention.

FIG. 3 shows the detailed structure of the coating supply apparatus 30 and 31. The coating supply apparatus comprise the frame parts 46 and 47 constituting, for example, box beams and affixed to the side beams 14 and 16, respectively, by the axles 19, so that they are turnable by hydraulic cylinders 18 and 21, respectively. The hydraulic cylinders 18 and 21 are in their positions 18' and 21', respectively, when the coating supply apparatus 30 and 31 are in their non-operating positions 30' and 31', respectively, and their tip parts are, as hereinbefore described, submerged in the liquid basins 23 and 24, respectively. The coating supply apparatus 31 includes axles 22, which correspond to the aforementioned axles 19.

A coating supply pipe 32 is provided inside the box beams 46 and 47. A coating agent is supplied to the coating supply pipe 32 from one or both ends of said pipe via connecting members 45. A plurality of arms 34 are connected to the sides of the box beams 46 and 47 that face the nip N. The filling pieces 37 and 38 of the invention are connected to the arms 34 via a T-joint 35, or the equivalent. As shown in FIG. 3, the filling pieces 37 and 38 have an essentially triangular cross-section and their tip parts 39 face the nip N. The filling pieces 37 and 38 are affixed to the arms 34 by a metal strip 36, or the equivalent, sufficiently strong, fixing.

A plurality of nozzle pipes 33 lead from the transverse coating supply pipes 32 toward the pools $L_1$ and $L_2$, supplying the coating via their ends 33*a* and 33*b* to said pools. The pools $L_1$ and $L_2$ have a surface S. The surface S of the pools is preferably essentially at the level of the upper side of the filling pieces 37 and 38.

The filling pieces 37 and 38 constitute liquid permable porous, material or corresponding perforated material such as, for example, Teflon, rubber or plastics, for example, polyethylene. The diameters of the holes of the filling pieces 37 and 38 are, for example, 1–10 mm and the share of holes or pores of the whole volume of said filling pieces is about 30 to 70%, preferably about 50%. The nozzle pipes 33 have a diameter D of about 20 mm, for example.

The filling pieces 37 and 38 suppress the coating pools $L_1$ and $L_2$ and thus prevent the aforementioned splashing. The significance of the filling pieces 37 and 38 is that the larger said filling pieces, the higher the running speed of the web W.

A small space may be left between the filling pieces 37 and 38 and the coating rollers 10 and 20, or said filling pieces may also have contact with the mantle of said rollers. The filling pieces 37 and 38 extend for the entire width of the web W. The form of the filling pieces 37 and 38 may differ considerably from that hereinbefore described. In some applications, the filling pieces 37 and 38 may be limited in position to close to the coating agent surface S of the coating pools $L_1$ and $L_2$, only. In such positions they prevent the splashing of the coating agent, at least to some extent.

Devices for keeping the surfaces of the rollers clean are connected to the rollers 10 and 20. Of these devices, a doctor 25, which scrapes coating agent into a pan 26, is shown in FIG. 1. The coating agent overflowing from the ends of the roller nip is led off in the direction of arrows F (FIG. 2) via connecting members 43.

When the size press is used for treating the web W only unilaterally, the guide roller is shifted into position 11*a* or 11*c*, and, from the side of the web to be untreated, the coating supply apparatus 30 and 31 and the connected filling pieces 37 and 38 are turned into the aforedescribed non-operating positions 30' and 31', respectively, wherein nozzle and coating supply pipes 33 and said filling pieces are immersed in the liquid in the basins 23 and 24, respectively. The coating supply apparatus of the side of the web W to be treated is in the operating position.

It is known from experience that in a size press it is advantageous to have a hard roller and a soft roller opposing each other, because holes tend to form in the paper in the nip between two hard rollers. An advantageous structure, for example, is one in which the roller 20 is a soft roller such as, for example, a rubber-covered roller, and the roller 10 is hard such as, for example, a "mikrorok"-covered roller. This type of roller arrangement has the advantage that the releasing of the web upon leaving the size press may be accomplished from the hard roller 10, because, as generally known, after the nip, the web tends to always follow the surface of the harder roller. The web is thus released from a hard roller with clearly better stability and smoothness than from a soft roller.

The invention is by no means restricted to the aforementioned details which are described only as examples; they may vary with the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A size press having at least two coating rollers forming with each other at least one coating nip through which the web to be treated is arranged to run and coating pools at the entrance of the nip between the coating rollers and the web entering said nip, said size press comprising coating supply apparatus for supplying a coating agent to said coating pools, said coating supply apparatus including filling pieces at said entrance of said nip placed in said coating pools in operation, said filling pieces consisting of one of a liquid permeable porous, and perforated material and suppressing said coating pools and substantially decreasing and preventing splashing of the coating agent.

2. A size press as claimed in claim 1, wherein said web has a predetermined width and said filling pieces extend for the entire width of said web.

3. A size press as claimed in claim 1, wherein each of said filling pieces has a substantially wedge-shaped cross-section with a tip part in a corresponding one of said coating pools, said tip part being directed towards said nip.

4. A size press as claimed in claim 3, further comprising positioning means coupled to said coating supply apparatus for turning said coating supply apparatus from an operating position to a non-operating position relative to said nip, and wherein said coating supply apparatus further includes basins containing liquid into which said tip parts of said filling pieces are submerged when said coating supply apparatus is in its non-operating position.

5. A size press as claimed in claim 4, wherein said coating pools have a surface level of the coating agent therein and said filling pieces are immersed in said pools in a manner whereby upper parts of said filling pieces reach approximately said surface levels of said coating pools when said coating supply apparatus is in its operating position.

6. A size press as claimed in claim 1, wherein said coating supply apparatus further includes frame parts, coating supply and distribution pipes in said frame parts and a plurality of arms connected to said frame parts, said filling pieces being connected to said arms.

7. A size press as claimed in claim 6, wherein said frame parts comprise box beams and said arms are affixed to ends of said box beams farthest from said nip.

8. A size press as claimed in claim 6, further comprising a frame, a pair of side beams rotatably mounted on said frame, power means coupled to said beams for turning said side beams, additional power means coupled to said coating supply apparatus and axles extending between and mounted in said side beams, and wherein said frame parts of said coating supply apparatus are mounted on and turnable around said axles by said additional power means.

9. A size press as claimed in claim 8, wherein said power means and said additional power means comprise hydraulic cylinders.

10. A size press as recited in claim 1 wherein each of said filling pieces comprises a perforated material and wherein perforations are formed through said filler piece which extend substantially transversely therethrough.

* * * * *